US005454925A

United States Patent [19]

Garland et al.

[11] Patent Number: 5,454,925

[45] Date of Patent: Oct. 3, 1995

[54] REPAIR OF MESH ELECTRODE SPACED FROM ELECTRODE PAN

[75] Inventors: Kevin B. Garland, Madison; Gerald R. Pohto; Edward M. Halko, both of Mentor; Zane A. Wade, Montville, all of Ohio

[73] Assignee: Eltech Systems Corporation, Chardon, Ohio

[21] Appl. No.: 237,569

[22] Filed: May 3, 1994

[51] Int. Cl.[6] ..... C25B 11/03

[52] U.S. Cl. ..... 204/280; 204/279; 204/286; 204/284; 29/402.01; 29/402.07; 29/402.08; 29/402.13; 29/402.16

[58] Field of Search ..... 204/279, 280, 204/286, 284, 283; 29/402.01, 402.07, 402.08, 402.13, 402.16; C25B 11/00, 11, 02, 11/03

[56] References Cited

U.S. PATENT DOCUMENTS

| | | | |
|---|---|---|---|
| 3,265,526 | 8/1966 | Beer | 117/50 |
| 3,632,498 | 1/1972 | Beer | 204/290 F |
| 3,711,385 | 1/1973 | Beer | 204/59 |
| 3,940,328 | 2/1976 | Thomas et al. | 204/283 |
| 4,088,558 | 5/1978 | Fabian et al. | 204/288 |
| 4,154,667 | 5/1979 | Pohto et al. | 204/286 |
| 4,528,084 | 7/1985 | Beer et al. | 204/290 F |
| 4,738,763 | 4/1988 | Abrahamson et al. | 204/255 |
| 4,923,582 | 5/1990 | Abrahamson et al. | 204/255 |

*Primary Examiner*—Kathryn Gorgos
*Attorney, Agent, or Firm*—John J. Freer; David J. Skrabec

[57] ABSTRACT

Electrodes such as mesh electrodes can be in configurations where they are separated from electrode back pans by standoffs. The mesh electrodes are very adherently secured to the standoffs. When the electrodes are in need of repair, removal and refurbishing can be a problem. There is now disclosed a method of electrode repair which in large part retains original structure by first removing the mesh electrode and then at least substantially the top of the standoff. A replacement standoff assembly is placed against the retained portion of the original standoff and secured thereto. Refurbished or new electrode mesh can be adhered to the resulting replacement standoff. This may include welding of mesh electrode strands utilizing weld nuggets which are substantially the size of the strands. The refurbishing technique can maintain original separation distances between the back pan and the electrode. The structure provided can be in an "as new" condition without need for repair at an off site location from where the electrode will be used.

45 Claims, 5 Drawing Sheets

REPAIR OF MESH ELECTRODE SPACED FROM ELECTRODE PAN

BACKGROUND OF THE INVENTION

Electrodes which can be of large planar shape and be formed of metal mesh often have an electrocatalytic coating which will suffer diminished electrocatalytic activity over a greatly extended use. These electrodes, thus, have to be refurbished for reuse. It has been known in such refurbishing, where such large planar mesh electrodes are secured to a riser and form part of an electrode assembly, to use at least a part of the electrode in the refurbishing. Thus, it is taught for example in U.S. Pat. No. 3,940,328 that such a previously used electrode may form a base to which a fresh electrode is secured. The old mesh electrode, which is adhered such as by welding to the riser, can be substantially cut away, nevertheless leaving a portion of the old electrode, which is secured to the riser, in place. Then a new electrode, which may be in envelope form, is slipped over the riser plus old portion of the mesh electrode. The new electrode can conform to the working faces of the old electrode.

The old planar electrode members may form more than a simple base for the new electrode members. In U.S. Pat. No. 4,154,667 it is taught that the old electrode member secured to a riser may be substantially cut away. This can leave electrode sections which are closest to the riser and bonded to the riser. By a forming operation, these sections may be made into spring-like members. The new electrode planar members are then secured to these spring-like members. Such a technique can be used for converting box form electrodes to expandable form electrodes.

Electrode assemblies other than for diaphragm cells include assemblies utilized in filter press electrolyzers. Such assemblies for these electrolyzers can have a mesh electrode which is separated by standoffs from a back pan. For example in U.S. Pat. No. 4,923,582, there are taught such electrode assemblies, which assemblies have spring members between back pans and electrode members. The assemblies are also subject to eventual diminishing of electrocatalytic coating activity for the electrodes. Thus, refurbishing these assemblies is necessary.

Since the electrodes can be welded to the members separating the electrodes from the back pans, which separating members are also usually welded to the back pans, refurbishing by replacement of the electrode members can be a problem. In removing the electrode from the back pan or from the standoff, it has been known to mechanically tear the electrode, e.g., an electrode in mesh form, away from the top of the standoff. However, where the electrode mesh is most secure to the standoff, e.g., at weld nuggets, these portions of the electrode mesh must be removed by further operation, such as grinding. This can very deleteriously effect the dimensions of the top of the standoff. To regain these dimensions, further operations such as punching must be utilized. The overall operation can be very labor intensive and thus uneconomical.

It would be desirable to be able to refurbish such assemblies efficiently and economically. This would not only be economy of refurbishing at the site of use of the assembly, e.g., an electrochemical plant, but also the economy of refurbishing the assembly without substantial destruction and thus substantial reconstruction of the assembly.

SUMMARY OF THE INVENTION

A refurbishing procedure has now been proposed which can economically and efficiently reconstruct assemblies utilized in filter press electrolyzers. The process makes use of much of the original electrode assembly structure. The process can be employed quickly and efficiently, yielding a refurbished assembly which can have the dimensions and tolerances of the original structure. Thus, on replacement, the refurbished assembly provides highly desirable consistent operation of the overall structure, e.g., the electrochemical cell.

The method is also desirably serviceable for utilization as a field recoating technique, without need for uneconomical servicing of electrodes in repair facilities located off site of cell operating plants. The electrode refurbished in the present invention is a most serviceable electrode member which is replaced in a cell without loss of efficiency of cell operation. The electrode in the refurbished structure can be attached in a plane parallel to the back pan, providing accurate location of the electrode with respect to the pan. The refurbished electrode structure of the present invention provides a most economical and efficient replacement for the original electrode structure removed from a cell.

In general, by the present invention, the old electrode mesh is more readily removed. It may first be cut back to just a very small retained portion at the top of standoffs, e.g., by using pneumatic or electric powered sheet metal shears. Then, the upper portion of the standoff, which portion may still engage some electrode mesh, is cut to remove not only any remaining old electrode mesh, but also at least a part of the standoff which was secured to the electrode mesh. At this stage of the refurbishing, there is retained much of the standoff.

In one aspect, the invention is directed to a method of repairing an electrode wherein a series of electrically conductive spaced-apart standoffs connect a mesh electrode to a back pan, each standoff comprising a projecting member, between the mesh electrode and the pan, plus an upper leg member which is in face-to-face contact with the electrode mesh, which method comprises;

separating at least a substantial amount of an upper leg member from a projecting member of a standoff, leaving a standoff projecting member;

inserting at least one replacement assembly, which is comprised of a projecting member plus an upper leg member, adjacent and in contact with the standoff projecting member, while bringing the replacement assembly projecting member in face-to-face contact with the standoff projecting member; while in such replacement providing a replacement upper leg member at the top of the original projecting member; thereafter securing the standoff and replacement projecting members in face-to-face contact with one another; and securing electrode mesh to the replacement upper leg member.

In another aspect, the invention is directed to a repaired electrode assembly having a back pan and a mesh electrode, with the pan and electrode being separated from one another by multiple, electrically conductive standoffs, such standoffs being spaced apart, one from the other, with each standoff comprising;

an elongate, original projecting member having long, flat side surfaces, which member at its bottom is secured to the back pan and projects upwardly from such back pan;

an elongate repair projecting member having long, flat side surfaces with at least a portion of one of such surfaces being in adherent, electrically conductive face-to-face contact with a long, flat side surface of the original projecting member; and an elongate repair upper leg member connected to, and in angled projection away from, said repair projecting member, said repair upper leg member being in secure, electrically conductive contact with said mesh electrode.

In yet another aspect, the invention is directed to an electrode assembly repair standoff comprising:

an elongate unit of L-shaped, C-shaped or T-shaped cross section having:

an elongate projecting member as a first leg of said L or T, or center of said C, which member has long, flat side surfaces and contains spaced-apart apertures through such member; and an elongate upper leg member as a second leg which second leg member is a mesh member in angled projection away from the projecting first member and has long flat surfaces.

In another aspect, the invention is directed to a repaired electrode assembly having a back pan and a mesh electrode; said pan and electrode being separated from one another by multiple, electrically-conductive standoffs; said mesh electrode being welded to said assembly during said repair, with the mesh electrode comprising strands connected at nodes and including strands welded to said assembly during said repair where the welding providing weld nuggets having width size which are at least substantially the size of the width of the mesh electrode strands.

A DESCRIPTION OF THE PREFERRED EMBODIMENTS

Figure 1:
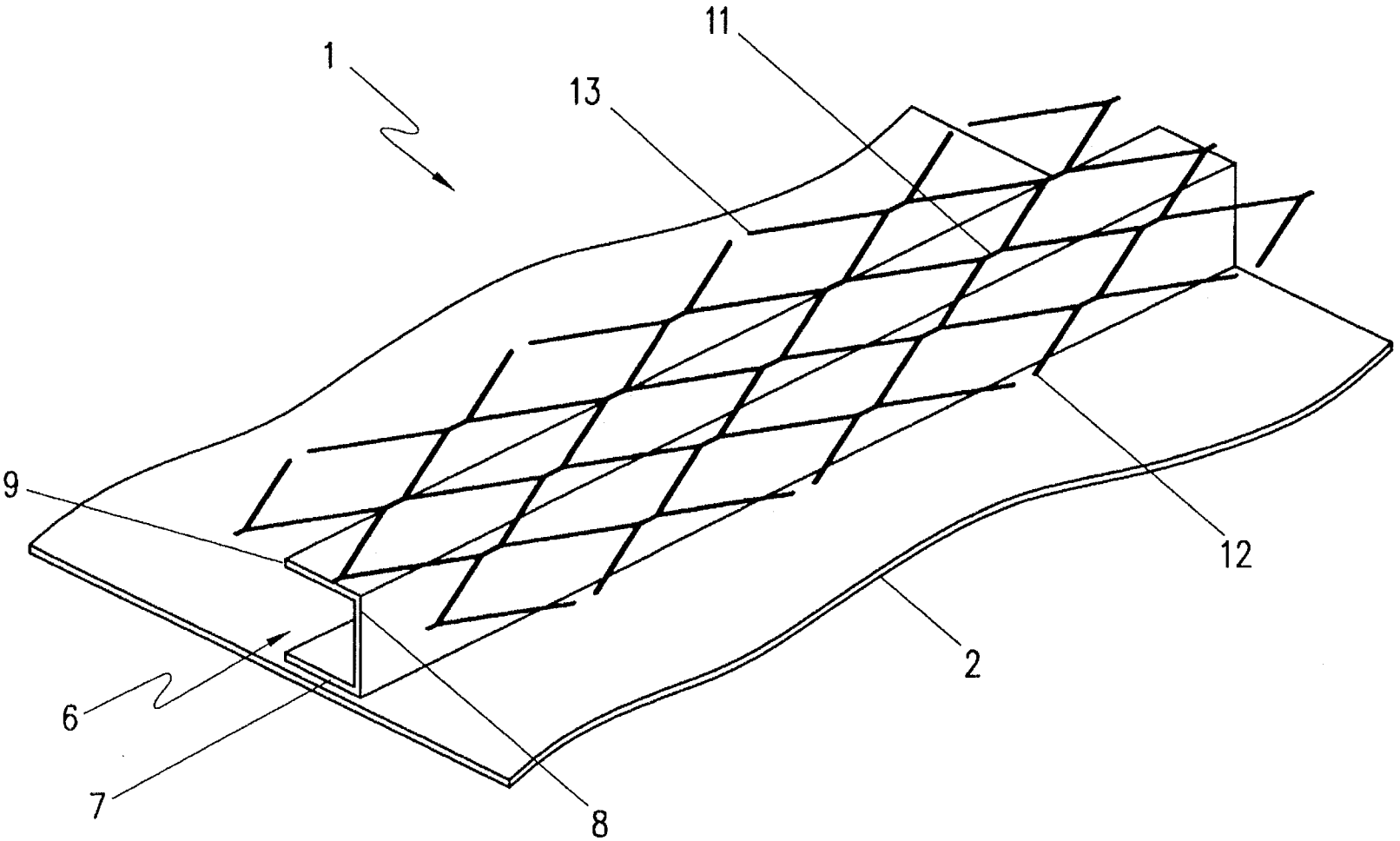
FIG. 1 is a perspective view of a portion only of an electrode assembly wherein only a part of a mesh electrode, adjacent a standoff, has been retained.

In a filter press electrolytic cell, an electrode element in planar form and having mesh structure, may be a metal mesh electrode such as an expanded titanium mesh. The mesh can comprise titanium, e.g., it may be fabricated from grade 1 or grade 2 titanium, or from an alloy or intermetallic mixture containing titanium, such as titanium-palladium alloy. Since the mesh electrode element will usually comprise titanium metal, such element may be referred to herein for convenience as the titanium electrode. However, it will be understood that other metals, typically valve metals including tantalum, niobium, and zirconium may also find use for such electrode element. This mesh element can bear an electrocatalytic coating. Representative coatings will be more particularly discussed further on hereinbelow. In use, the coating on the mesh can lose activity, requiring refurbishing of the electrode structure to provide mesh of fresh activity.

These mesh electrodes having an electrocatalytic coating, and being in generally planar shape, are usually spaced apart from a back pan by a multitude of spacer elements, also called standoffs. For convenience, these spacer elements, which may also be termed "separating members", will usually be referred to herein simply as "standoffs". They can be original standoffs, of an electrode assembly in need of refurbishing, or replacement standoffs, after the refurbishing. The original and replacement standoffs may be at least quite similar in configuration, so that, in general, no distinction will be made herein between original and replacement standoffs unless otherwise specified. The standoffs, in addition to being electrical conductors, provide support, and maintain a fixed dimension, between the mesh electrode and the back pan.

Usually, the standoff in cross section will be in a C-shape, (or "channel"), L-shape (or "angle") or T-shape form. The top member of the channel, or of the T or the like, may be referred to herein for convenience as the "upper leg". It may also sometimes be referred to as the "mesh member" of the standoff. The bottom member of the channel may be referred to herein as the "lower leg". The middle member of the channel between the upper leg and the lower leg, or the upright member of the T or the like, may usually for convenience be referred to herein as the "web", or "upright" or "projecting" member.

For providing support, the standoffs are rigid. This is rigidity in the direction from the back pan up to the electrode element. It is rigidity sufficient to maintain the dimension of the standoff in this direction during use, such as under the internal operating pressures encountered in cell operation. These standoffs also are desirably electrically conductive and corrosion resistant. For reasons such as these, standoffs comprised of titanium metal are typical. Titanium metal standoffs can have a desirable resistance to the conditions of their environment, e.g., resistance to corrosion from the electrolyte in an electrolytic cell, such as a chlor-alkali cell for electrolyzing brine. They can also be serviceable in conducting electricity from a back pan to the electrode. Although the standoffs may generally be referred to herein for convenience as titanium metal standoffs, it is to be understood that other metals, typically valve metals, may be useful in the manufacture of the standoffs. These can include metals such as tantalum, niobium, and zirconium. Where they are titanium, grade 1 or, grade 2 or grade 7 may be used, which grade 7 can include up to 0.25 weight percent palladium, with grade 7 being preferred because of its crevice corrosion resistance.

The standoffs can have apertures. For example, the web member can be apertured so as to permit circulation of electrolyte within the cell through the standoff. These apertures for the web are typically circular, but other shapes such as elliptical are contemplated. Usually, these apertures when circular will have a diameter of about 0.25 inch and will be well spaced apart, e.g., at a distance of about one to 1½ inches between adjacent apertures. Moreover, the upper leg of the standoff which is in contact with the mesh electrode, may be in a perforated form, e.g., in a mesh form. The standoff at its foot, e.g., the lower leg of a channel member, may be welded to a metal back pan and its upper leg may be welded to a metal mesh electrode. When the standoff in cross section will be in a C-shape, L-shape or T-shape form, the bottom or the base which is against the back pan is at the base of the T or the lower leg of the C. In this same sense, because an L-shape standoff is used in inverted manner, the leg of the L is actually an upper leg which is against the mesh electrode.

Referring now more particularly to FIG. 1, a part of a back pan 2 of a portion of an electrode assembly 1 has secured thereto a C-shaped standoff 6 having a lower leg member 7, upright web member 8 and upper leg member 9. The upper leg member 9 serves as a platform to which a mesh electrode 11 is secured. The more normally extensive mesh of the electrode assembly 1 has been cut and removed, exposing rough edges 12, 13, and the balance of the mesh electrode assembly 1 is not shown. A small portion of the mesh electrode 11 is still present on the upper leg member 9, which is the preferred operation, although other cutting variations will be discussed further on hereinbelow.

Figure 2:
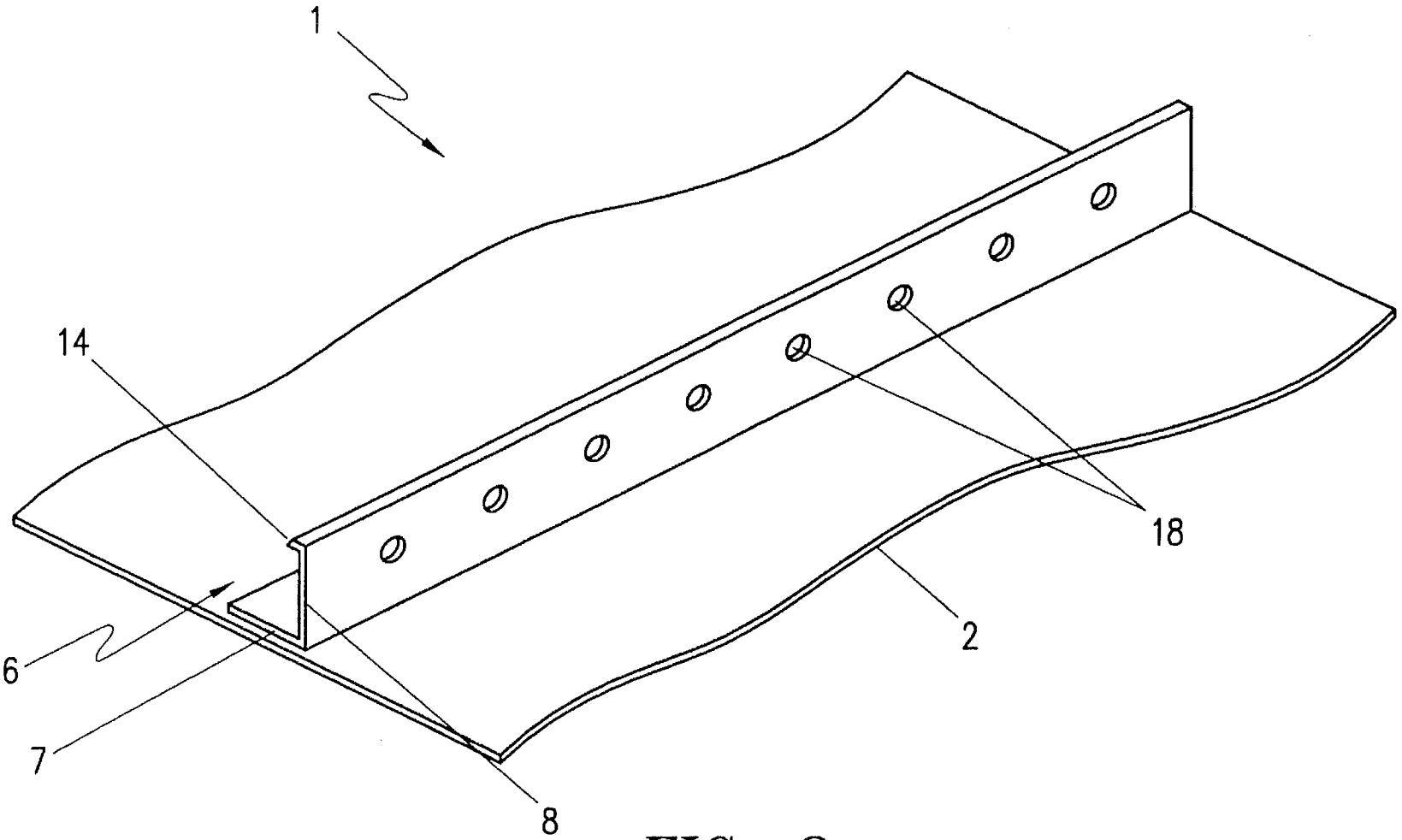
FIG. 2 is a perspective view of the electrode assembly portion of FIG. 1, but with the mesh electrode, as well as much of the top of the standoff, removed.

Referring then to FIG. 2, for the electrode assembly 1, the upper leg member 9 has been cut, almost at its juncture with the web member 8, and the cut portion of the leg member 9 has been removed. Thus a substantial amount of the upper leg member 9 has been removed. Together with this removal, there has been removed the small portion of the mesh electrode which was attached to the standoff 6. This exposes apertures 18 which are present through the long, flat sides of the web member 8. Retained on the back pan 2, there is the lower leg member 7 and web member 8 of the standoff 6 which now has an upper, fresh cut edge 14. Retaining a small portion of the upper leg member 9 after cutting is preferred, although other variations are suitable, e.g., see FIG. 5. By removing "a substantial amount" of the leg member 9, it is meant that preferably only a small portion is retained, as shown in the figure, but it is also to be understood that at least more than such small portion may be retained.

Figure 3:
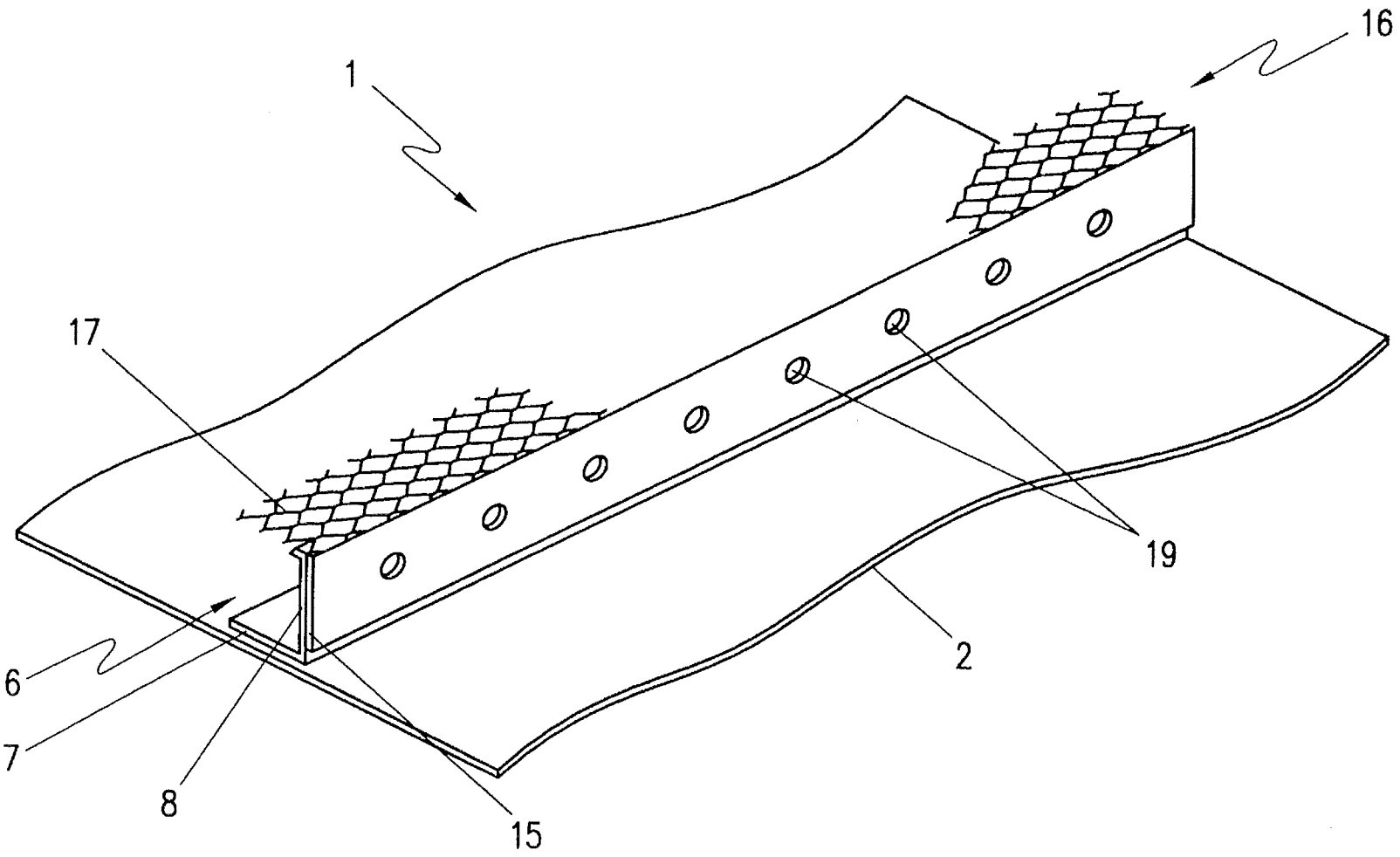
FIG. 3 is a perspective view of the assembly of FIG. 2 having a refurbished standoff, for connecting a mesh electrode to a back pan, which standoff is refurbished in accordance with one aspect of the present invention.
Figure 4:
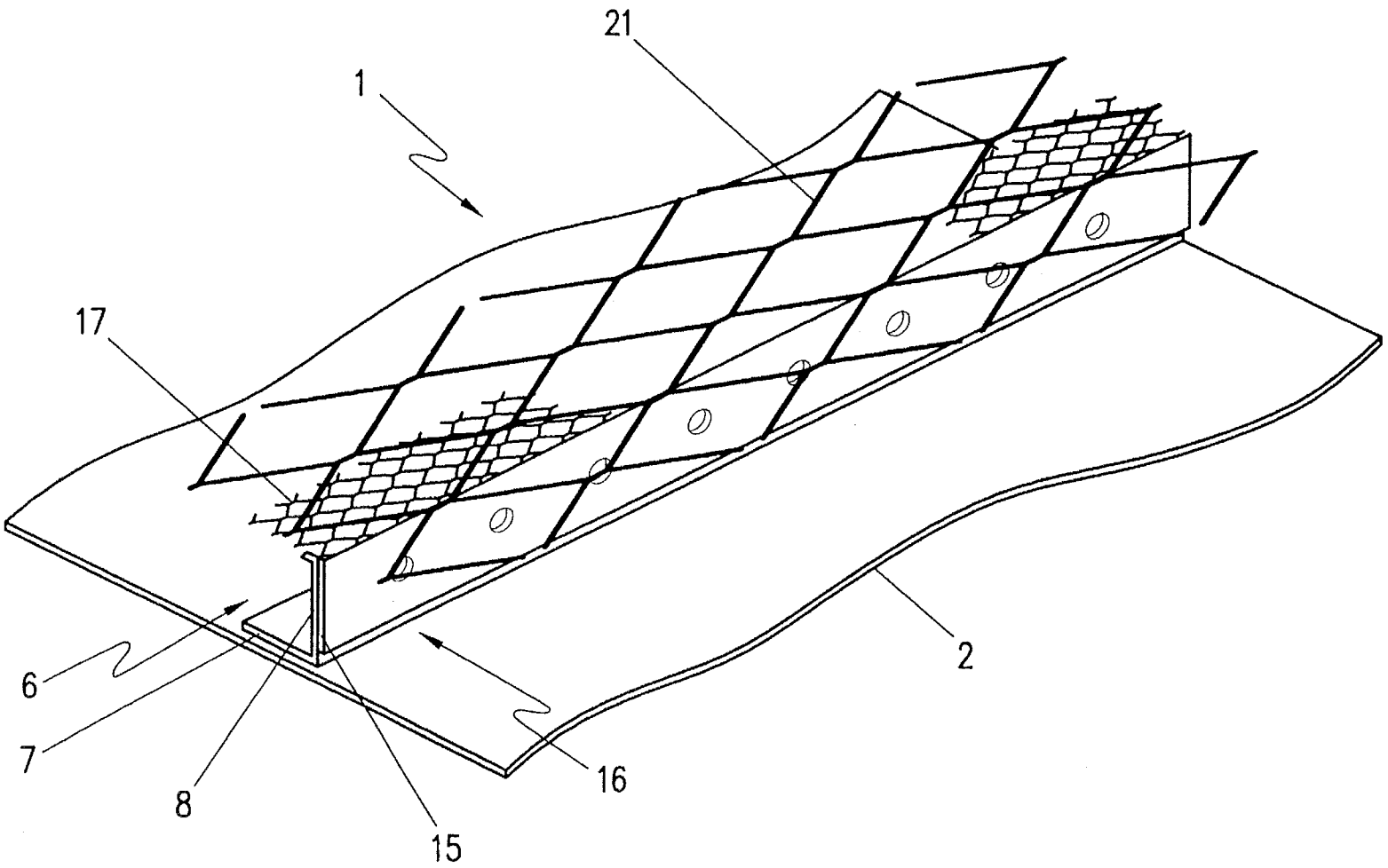
FIG. 4 is a perspective view of the assembly of FIG. 3 having mesh connected at the top of the refurbished standoff.

Referring then more particularly to FIG. 3, the back pan 2 of the electrode assembly 1 has secured thereto the original lower leg member 7 from which projects the original web member 8 of the original standoff 6. These original elements include web member 8 now in side-by-side and face-to-face contact with the new web member 15 of a replacement standoff member, more particularly the standoff angle 16 (of inverted L-shape). This replacement standoff angle 16 has an upper leg member 17 which is in perforate form, e.g., mesh form. This upper leg member 17 extends over the fresh cut edge 14 (FIG. 2) from the original upper leg member 9 (FIG. 1). Further, this replacement standoff angle 16 has apertures 19 through the new web member 15, and these apertures 19 align with the apertures in the original web member 8. After the new web member 15 has been placed side-by-side with the original web member 8 and secured thereto, e.g., by welding, the mesh, or upper leg, member 17 will serve as a support base for a replacement mesh electrode (FIG. 4). This mesh electrode may be secured to the upper leg member 17 such as by welding.

In FIG. 4, the retained portion of the original standoff 6 in combination with the replacement standoff angle 16, determine the spacing between a replacement mesh electrode 21 from the back pan 2. This standoff assembly now contains the lower leg 7 plus web member 8 from the original standoff 6, as well as the new web member 15 and mesh member 17 of the replacement standoff 16. The replacement mesh electrode 21 has been secured to the mesh member 17 such as by welding. This refurbished electrode assembly 1 is then ready for return to a cell, not shown.

Figure 5:
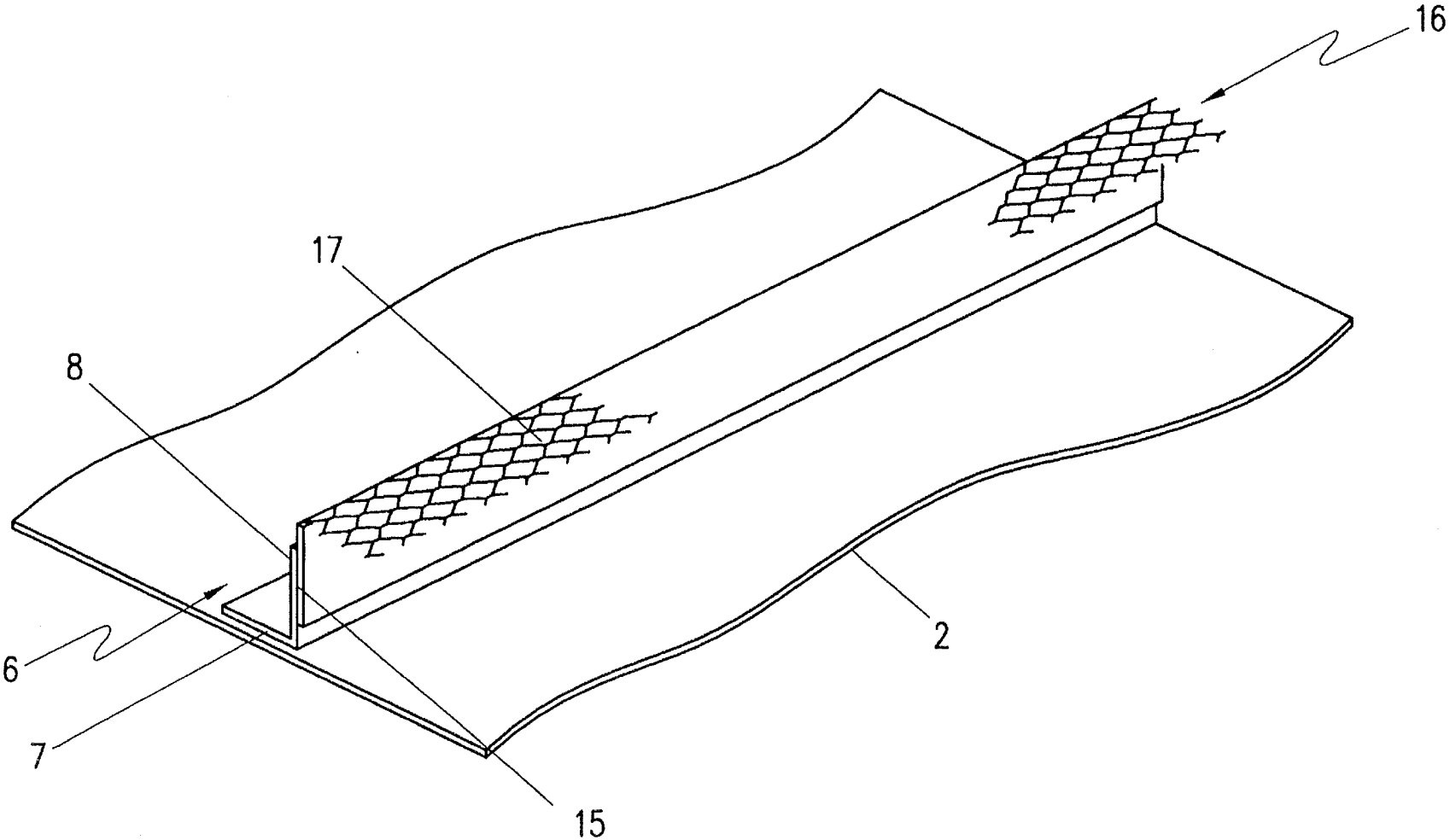
FIG. 5 is a perspective view of a refurbished standoff which is a variant of the assembly of FIG. 3.

FIG. 5 will be discussed further on hereinbelow in connection with variations in the replacement and standoff member.

In the replacement operation, the original electrode mesh is typically cut away, retaining only a small portion of mesh 11 on a standoff 6. The small portion of retained mesh 11 can be just on the upper leg 9 of the standoff 6. This, however, need not be the case, e.g., there does not need to be a first mesh cut. Where removal is not initiated by simply a mesh cut, a cut through the standoff as shown in FIG. 2, which will also cut mesh, can be sufficient. This can either result in cutting off the mesh, or if any mesh is retained it is readily pulled away. Where the mesh is first cut, the standoff 6 is then cut to remove the mesh 11 and at least a substantial portion of the upper leg 9 of the standoff 6. There is then taken a replacement standoff assembly such as angle 16 which has a web member 15 that is put in face-to-face contact with the retained web member 8 and secured thereto. This positioning includes placement of a replacement upper leg member 17 at the cut-away edge 14 of the original standoff 6. The replacement web member 15 also desirably has apertures 19 which can be aligned with the apertures 18 in the retained web member 8. The replacement web member 15 can thus be at least essentially the same dimensions as the retained web member 8. It usually is at least substantially in angle form, having two long, flat side surfaces.

The replacement standoff angle 16 will have at its top an upper leg member 17 which angles away from the web member 15. This can be an upper leg member 17 in perforate form. This can be many small perforations, e.g., many 0.25 inch, or less, diameter circular holes punched through the upper leg member 17. Usually, the perforate upper leg member 17 will be a mesh, such as of expanded metal. One face of this upper leg member 17, i.e., its outer, or upper face, will serve as a support for a refurbished or new mesh electrode 21. In this refurbishing operation, the original web member 8 and the new web member 15 of the new standoff angle 16 can be secured together such as by welding. This can be welding between each aperture 19, when such apertures 19 are present. The retained portion of the original standoff 6, plus the new standoff angle 16, thus form the replacement standoff. It will be understood that the new standoff angle 16 having an upper leg member 17 in perforate form and a web member 15 in apertured, i.e., perforate, form, may suitably be any such angle 16 as has perforations in both members. Thus, the angle 16 may be made completely of expanded metal in mesh form. The new web member 15 may be secured to the original web member 8 as by welding at the nodes of the mesh of the new web member 15.

Although the replacement standoff member has been shown as an angle 16, it will be understood that such member could be T-shaped or the like. This could be the case even where the original standoff 6 is T-shaped. Thus, it will be understood that variations of this kind are contemplated in refurbishing the standoffs. One variation of particular interest is shown in FIG. 5. Therein, a back pan 2 has secured thereto the lower leg member 7 of a standoff 6. The web member 8 of the standoff 6 has been cut below the original upper leg member (not shown). Then a replacement standoff member as angle 16 has been secured to the near side of the remaining portion of the original standoff 6. The securing has been between the original web member 8 and the web member 15 of the replacement standoff angle 16. Later, a refurbished or new perforate electrode (not shown) can be secured to the upper leg member 17 of the replacement standoff angle 16. As discussed hereinbefore, the upper leg member 17 may be a perforate leg member.

It will be understood that, in another variation, if the replacement standoff member were a channel member, it could be replaced in a manner similar to the angle 16, i.e., having a web member 15 secured to the original web member 8. The lower leg of the replacement channel member would then project away in opposite manner from the projection of the lower leg member 7 of the original standoff 6. That is, the original channel-shaped standoff and the replacement channel member can be placed back-to-back.

Moreover, if the replacement standoff member were T-shaped, its upper leg member could be in part as shown, plus contain a section which extends over the cut upper edge of the original web member 8. Also, the replacement standoff angle 16 could be supplemented by a second replacement standoff angle, not shown, which could be placed on the far side of the remaining portion of the original standoff 6 (the replacement standoff angle 16 plus supplemental standoff angle thereby providing an assembly having a somewhat gull-wing shape). Such a second angle would have an upper leg parallel and above the original standoff lower leg member 7.

In general, standoffs are elongate members such that each of their elements, e.g., web members and leg members are also elongate members. As individual elements in typically ribbon form, that is, being thin and long, these can be quite flexible, e.g., a leg member element alone could be readily subject to bowing. However, together as a unit such as in a C-shaped, L-shaped or T-shaped replacement assembly, they have the rigidity typical of angled members. It is important that they have rigidity in the direction from the back pan to the electrode mesh as discussed hereinabove. It is also desirable that they have at least substantial rigidity for the upper leg member so as to reduce any bowing of the electrode mesh, in a downwardly direction toward the pan, in the unsupported areas of the electrode mesh between the standoffs.

In ribbon form, each of the web member and leg member elements are in elongate form and have long flat surfaces. Such long flat surfaces can be most serviceable for placing adjacent surfaces together for original and replacement members and then securing these members together by welding. Although these members have been shown in the figures to be essentially linear, it is understood that other shapes are contemplated. Thus for example the elongate members can be in corrugated form. It is also contemplated that the replacement assembly could be clip shaped, e.g., shaped like a binder clip for holding a sheaf of papers. It could clip down over an original web member. The flat-surfaced back of the clip facing upwardly can serve as the element to which the electrode element is secured. The clip shaped replacement assembly can be useful if the entire original leg member is removed. The flat-surfaced back of the clip thus serves as a replacement leg element. If the entire original leg member is entirely removed without more, e.g., no clip member or replacement assembly is used, then, the replacement electrode mesh may need to be affixed to the upper exposed end of the original web member. It is contemplated that for at least some standoffs this may be the case. That is, the electrode mesh will be secured to the upper exposed end of the original web member, or to the upper web member end as shown in FIG. 2., having little, original leg member remaining. Preferably, at least one replacement assembly will be used with each standoff and advantageously a clip member will be used where a replacement assembly is not utilized.

Usually, the standoffs will have each element such as a leg member having a thickness of from about 0.02 inch to about 0.06 inch. A typical standoff may be about 40 to 80 inches in length. When welding has been mentioned herein, it will be understood that this is the securing means of choice. However, other securing means are contemplated. Such means might include riveting, as with titanium rivets. Also, the web members 8, 15 may be brazed together, providing desirable, electrically conductive contact between these members. Generally, the standoffs will be useful to carry electrical current between the back pan and the electrode. Thus, securing means used in replacement techniques preferably maintain this characteristic. When welding is used herein, it may take the form of resistance welding, tungsten inert gas welding, electron beam welding, diffusion welding, and laser welding, by way of example.

As has been mentioned hereinbefore, the replacement mesh electrode 21 can be secured such as to the mesh member 17 as by welding (FIG. 4). Where welding will be used, particularly where it will take the form of resistance welding; the welding can secure a strand of the mesh electrode to an underlying replacement leg member. As noted in FIG. 4, the electrode mesh comprises a great many strands which intersect at nodes. Although the welding of the mesh to the underlying element can be principally at the strands of the mesh, it is contemplated that such will take place at both the strands and nodes of the electrode mesh. For a representative electrode mesh made of expanded metal, the strands can have a width on the order of about 1/32 of an inch. For the present invention it is contemplated that the weld nugget retained after welding such strand to the underlying element, will have size for the width of such nugget of at least substantially the strand width size, e.g., no more than one to two times the size for the width of the strand. hence, typically a weld nugget will have width size on the order of about 1/16 to about 1/32 of an inch. If the electrode mesh is to be welded at the nodes, it is also contemplated that the weld nugget retained at the node be essentially no larger than the node size. Thus, in the replacement operation, the assembly prepared for use, can have an electrode mesh which is at least substantially welded to the underlying elements at the strands of the mesh, with the weld nuggets being at least substantially the same size, i.e., width, as the strand width.

As representative of the electrochemically active coatings that may be applied to the replacement mesh electrode 21 (FIG. 4) are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385, and 4,528,084. The mixed metal oxide coatings can often include a platinum group metal including platinum, palladium, rhodium, iridium and ruthenium or mixtures of these as well as mixtures with other metals. Further coatings can comprise tin oxide, manganese dioxide, lead dioxide, cobalt oxide, ferric oxide, platinate coatings such as $M_xPt_3O_4$ where M is an alkali metal and X is typically targeted at approximately 0.5, nickel-nickel oxide and nickel plus lanthanide oxides.

We claim:

1. A method of repairing an electrode assembly wherein a series of electrically conductive spaced-apart standoffs connect a mesh electrode at their top to a back pan at their bottom, each standoff comprising a projecting member, between said mesh electrode and said pan, plus an upper leg member which is a member in face-to-face contact with said electrode mesh, which method comprises:

separating at least a substantial amount of an upper leg member from a projecting member of a standoff, leaving a standoff projecting member;

inserting at least one replacement assembly, which is comprised of a projecting member plus an upper leg member, adjacent and in contact with the standoff projecting member, while bringing said replacement assembly projecting member in face-to-face contact with said standoff projecting member; while in said replacement providing a replacement upper leg member at the top of said original projecting member; thereafter securing said standoff and replacement projecting members in face-to-face contact with one another; and securing electrode mesh to the replacement upper leg member.

2. The method of claim 1, wherein said original standoffs and replacement members are at least substantially in the shape of a C, T or L in cross-section and said upper leg member forms the top of said C or T or bottom of said L.

3. The method of claim 1, wherein projecting members in face-to-face contact are elongate metal members having long flat surfaces secured to one another by welding.

4. The method of claim 1, wherein said original projecting members have apertures, said replacement projecting members have apertures, and the apertures of said members secured together are in alignment.

5. The method of claim 1, wherein said replacement upper leg member is placed to project across the top of an adjacent original projecting member.

6. The method of claim 1, wherein said replacement upper leg member is placed to project away from the top of an adjacent original projecting member.

7. The method of claim 1, wherein said electrode mesh comprises a metal mesh which is secured by welding to a replacement upper leg metal member.

8. The method of claim 1, wherein said electrode mesh is a coated metal mesh which is uncoated in the area of contact with said replacement upper leg member.

9. The method of claim 1, wherein upper leg members of replacement members are in perforate form.

10. The method of claim 1, wherein old electrode mesh is removed from between standoffs before separating upper leg members.

11. The method of claim 1, wherein said replacement standoffs conduct electrical current from said back pans to said electrode mesh.

12. The method of claim 1, wherein there are inserted replacement angle members adjacent original projecting members.

13. A repaired electrode assembly having a back pan and a mesh electrode, which pan and electrode are separated from one another by multiple, electrically conductive standoffs, which standoffs are spaced apart, one from the other, with each standoff comprising:

an elongate, original projecting member having long, flat side surfaces, which member at its bottom is secured to said back pan and projects upwardly from said back pan;

an elongate repair projecting member having long, flat side surfaces and having at least a portion of one of said surfaces in adherent, electrically conductive face-to-face contact with a long, flat side surface of said original projecting member; and an elongate repair upper leg member connected to, and in angled projection away from, said repair projecting member, which repair upper leg member is in secure, electrically conductive contact with said mesh electrode.

14. The repaired electrode of claim 13, wherein each of said original projecting members and each of said repair projecting members is an apertured member in at least substantially ribbon form.

15. The repaired electrode of claim 14, wherein said apertures for each original projecting member are in alignment with the apertures of at least one repair projecting member.

16. The repaired electrode of claim 15, wherein said apertures in alignment are circular in shape and are spaced apart from about one inch up to about 1½ inches distance from one another.

17. The repaired electrode of claim 13, wherein each original projecting member is a metal member which is welded to a metal repair projecting member.

18. The repaired electrode of claim 13, wherein said repair upper leg member is a metal member in at least substantially perforate form.

19. The repaired electrode of claim 18, wherein said upper leg member is an expanded metal mesh having the shape of a diamond voids.

20. The repaired electrode of claim 13, wherein said repair projecting member and repair upper leg member are together as a unit, and in cross section are at least substantially in the shape of a C, T or L.

21. The repaired electrode of claim 13, wherein said repair projecting member connects to said pan.

22. The repaired electrode of claim 13, wherein said repair upper leg member is a metal member which is welded to said mesh electrode.

23. The repaired electrode of claim 22, wherein said mesh electrode is a coated, expanded metal mesh electrode.

24. The repaired electrode of claim 23, wherein said coating is an electrochemically active coating.

25. The repaired electrode of claim 24 wherein said active coating comprises a platinum group metal or contains at least one oxide selected from the group consisting of platinum group metal oxides, magnetite, and oxides of cobalt, manganese, and lead.

26. The repaired electrode of claim 25, wherein said active coating contains a mixed oxide material of at least one oxide of a valve metal and at least one oxide of a platinum group metal.

27. The repaired electrode of claim 13, wherein said original and repair projecting members and said repair upper leg member are all metal members comprising titanium metal.

28. The repaired electrode of claim 27, wherein said projecting members have a thickness of from about 0.02 inch to about 0.06 inch and said upper leg member has a thickness of from about 0.02 inch to about 0.06 inch.

29. The repaired electrode of claim 13, wherein said repair upper leg member projects across the top of an original projecting member.

30. The repaired electrode of claim 13, wherein said repair upper leg member projects away from the top of an original projecting member.

31. The repaired electrode of claim 13, wherein said elongate repair projecting member together with said elongate repair upper leg member are in the shape of a clip.

32. An electrode assembly repair standoff comprising:

an elongate unit having the shape of an L, a C or a T in cross section having:

an elongate projecting member as a first leg of said L or T, or center of said, which member has long, flat side surfaces and contains spaced-apart apertures through said member; and an elongate upper leg member as a second leg, which second leg member is a perforate member in angled projection away from said projecting first member and has long flat surfaces.

33. The electrode standoff of claim 32, wherein said projecting first member is an apertured member in at least substantially ribbon form.

34. The electrode standoff of claim 32, wherein said perforate member is at least substantially in ribbon mesh form.

35. The electrode standoff of claim 32, wherein said elongate unit is a metal unit containing titanium.

36. The electrode standoff of claim 35, wherein said metal unit has a projecting first member thickness of from about 0.02 inch to about 0.06 inch and an upper leg second member thickness of from about 0.02 inch to about 0.06 inch.

37. The electrode standoff of claim 32, wherein said upper leg second member is an expanded metal mesh having voids which are substantially in the shape of a diamond.

38. The electrode standoff of claim 32, wherein said projecting first member has apertures which are spaced apart from about one inch up to about 1½ inches distance from one another.

39. The electrode standoff of claim 32, wherein said stand-off is a rigid, metal, electrically conductive as well as corrosion resistant standoff.

40. A method of repairing an electrode assembly wherein a series of electrically conductive spaced-apart standoffs connect a mesh electrode at their top to a back pan at their bottom, each standoff comprising a projecting member, between said mesh electrode and said pan, plus an upper leg member which is a member in face-to-face contact with said electrode mesh, which method comprises:

separating at least a substantial amount of an upper leg member from a projecting member of a standoff, leaving a standoff projecting member; and securing electrode mesh to the retained standoff projecting member.

41. The method of claim 40, wherein a clip is secured over said retained standoff projecting member and said electrode mesh is secured to said clip.

42. A repaired electrode assembly having a back pan and a mesh electrode, which pan and electrode are separated from one another by multiple, electrically-conductive standoffs, and the mesh electrode is welded to said assembly during said repair, with the mesh electrode comprising strands connected at nodes and including strands welded to said assembly during said repair, the welding providing weld nuggets having width size which are at least substantially the size of the width of the mesh electrode strands.

43. The repaired electrode assembly of claim 42, wherein the mesh electrode is an expanded metal mesh and said metal is a valve metal.

44. The repaired electrode assembly of claim 43, wherein said valve metal mesh is titanium mesh and the strands of said mesh have a width of about 1/32 of an inch.

45. The repaired electrode assembly of claim 44, wherein the weld nuggets have width dimension of about 1/32 of an inch.

* * * * *

UNITED STATES PATENT AND TRADEMARK OFFICE

CERTIFICATE OF CORRECTION

PATENT NO. : 5,454,925

DATED : October 3, 1995

INVENTOR(S) : K. B. Garland et al

It is certified that error appears in the above-indentified patent and that said Letters Patent is hereby corrected as shown below:

Claim 32, column 10, line 61 of the patent, after "said" insert --C--.

Signed and Sealed this

Twenty-third Day of January, 1996

*Attest:*

Bruce Lehman

BRUCE LEHMAN

*Attesting Officer*

*Commissioner of Patents and Trademarks*